US005375279A

United States Patent [19]

Toso

[11] Patent Number: 5,375,279

[45] Date of Patent: Dec. 27, 1994

[54] COMBINATION STRETCHING AND BACK SUPPORT DEVICE

[76] Inventor: Victor Toso, 2438 Como Ave., SE., St. Paul, Minn. 55108

[21] Appl. No.: 22,508

[22] Filed: Feb. 25, 1993

Related U.S. Application Data

[63] Continuation-in-part of Ser. No. 981,535, Nov. 25, 1992, Pat. No. 5,235,714.

[51] Int. Cl.[5] ..... A47C 20/00; A61D 1/00

[52] U.S. Cl. ..... 5/657; 5/633; 5/648; 602/36

[58] Field of Search ..... 5/652, 657, 624, 633, 5/621, 648; 297/468, 485, 466; 602/23, 24, 25, 36

[56] References Cited

U.S. PATENT DOCUMENTS

| | | | |
|---|---|---|---|
| 1,015,812 | 1/1912 | Madsen | 5/633 |
| 1,266,374 | 5/1918 | Ziegler | 5/633 |
| 2,966,906 | 1/1961 | Wiltrout | 602/36 |
| 4,010,744 | 3/1977 | Boyen | 602/36 |
| 4,813,080 | 3/1989 | Toso | 5/652 |
| 4,934,005 | 6/1990 | Martin | 5/652 |

FOREIGN PATENT DOCUMENTS

| | | | |
|---|---|---|---|
| 28347 | 10/1930 | Australia | 5/633 |
| 5919 | of 1913 | United Kingdom | 5/633 |

*Primary Examiner*—Flemming Saether
*Attorney, Agent, or Firm*—Aquilino & Welsh

[57] ABSTRACT

A combination back support for use during stretching and/or sitting with the legs extended or not extended. The device includes a substantially rectangular lumbar back support with a multiplicity of pairs of inelastic straps used in a first configuration to engage the knees of a user and with the addition of a strap extension used to engage the feet of a user. When the user is in one of the various seated positions, the straps are connected to form loops which are fitted over either the feet or Knees of the user. As the user applies pressure with the feet or knees, the lumbar rectangular support is pulled tight around the user's lower back, providing ample support.

13 Claims, 7 Drawing Sheets

COMBINATION STRETCHING AND BACK SUPPORT DEVICE

This is a continuation-in-part of my co-pending U.S. patent application Ser. No. 07/981,535 filed Nov. 25, 1992, now U.S. Pat. No. 5,235,714.

BACKGROUND OF THE INVENTION

1. Field of the Invention

The present invention relates to back support devices, and in particular to a device which combines stretching exercise movements and seated back support in a single device.

2. Description of the Prior Art

As described in my previous U.S. Pat. No. 4,773,106, when an individual is seated upright on a flat surface without a back support, such a position becomes uncomfortable due to the lack of support at the lumbar region. This is particularly true for people with poor posture and/or a weak back structure. For people who sit in upright positions for long periods of time, the back support disclosed in the aforementioned patent used a padded back support sized to fit the lumbar region of a user connected to a pair of inelastic straps which extend from the ends of the support and terminate in loops to engage the knees of the user. The pressure of the user's knees and legs pulls the support member against the lumbar region, thereby providing sufficient support to enable the user to sit in upright positions for extended periods. Athletes who perform various stretching exercises have a need for back support throughout the entire stretching motion. Heretofore the prior art has failed to provide adequate back support for the various positions necessary for a proper stretching program as is provided by the present invention.

Additional prior art includes my U.S. Pat. Nos. 5,083,554 and 4,813,080 and patents to Wildermuth (U.S. Pat. No. 2,280,274) and Stevens (U.S. Pat. No. 3,295,517). The prior art references fail to provide for a device which provides back support while performing stretching exercising. The references further fail to provide for a multiconfigurable device which provides back support while in a plurality of positions: seated with the legs extended, seated with the legs crossed and/or in the usual upright seated position. Additionally, none of the prior art systems have the strap and buckle configuration of the present invention.

SUMMARY OF THE INVENTION

A general object of the invention is to provide a method of sitting with the legs out-stretched while providing comfortable back support.

Additionally it is an object of the invention to provide a manner of stretching muscles that are difficult to stretch without compromising the lumbar spine in the process.

Another object of the invention is to provide adequate adjustability in all features to make the present invention fit to all sizes.

The present invention includes a substantially rectangular lumbar back support with a multiplicity of pairs of inelastic straps configured in a first configuration to engage the feet of the user, and in an alternative configuration, to engage the knees of the user. When the user is in one of the various seated positions the straps are connected to form loops which are fitted over either the feet or knees of the user. As the user applies pressure with the feet or knees, the lumbar rectangular support is pulled tight around the user's lower back, providing ample support.

The invention keeps the lumbar spine supported such that it will not be compromised by the required muscular effort used to stretch by leaning forward. In addition, the device will allow greater hamstring stretching while leaning backwards.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
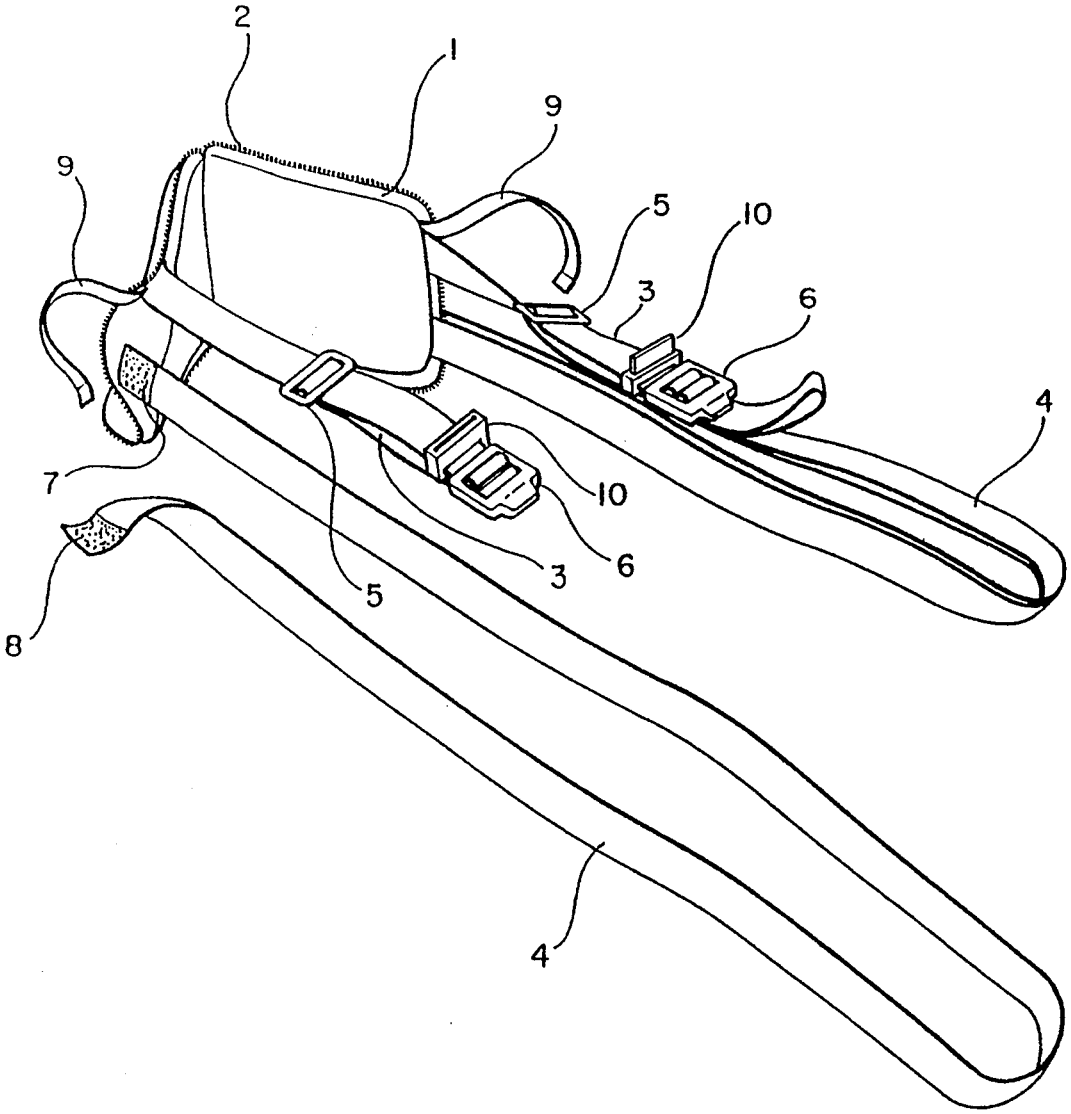
FIG. 1 is a perspective view of the present invention with differing strap configurations.

FIG. 1 shows the present invention with the straps 3 and 4 configured in two different arrangements—connected and not connected respectively. The device consists of a padded back support 1 which is shaped to wrap around the lower back portion of the user and provides support to the lumbar region. In this embodiment, the back support 1 is formed of a unitary, double-ended, flexible, and substantially rectangular member. The back support includes an interior section (not shown) containing a series of longitudinally directed belts (not shown) providing support which are preferably made of a strong fabric material such as canvas or a belting material. The interior section further includes a foam pad (not shown) which extends substantially the length and width of the support. The interior section is covered by a flexible fabric material which is fit over and secured by sewing. A further description of a typical support member may be found in my prior U.S. Pat. No. 4,773,106, which is hereby incorporated by reference.

An identical pair of straps, elements 3 and 4, extend from each end of the back support 1 and are attached to the ends of the support 1 by a suitable conventional means such as sewing or the like. Alternatively, the straps 3 and 4 may be integral extensions from each end of support 1. Strap 3 has three buckles 5, 6 and 10. Buckle 5 is preferably a tri-slide buckle used for adjusting the length of strap 3 so as to position the buckle 6 in a comfortable position for the user. Buckle 6 is a ladder-lock adjustment buckle for engaging the end of strap 4 and allowing adjustment thereof. Buckle 10 is a "snap-in" type fastener which can be connected to its paired buckle on the opposite strap 3. The specific buckles cited are for the preferred embodiment. It should be recognized that any suitable and functionally equivalent buckles could be used. Each of the respective straps 4 has a velcro fastener 8 which is used to fasten the end of the strap 4 to the support 1 at a velcro receptor patch 7. This attachment could be embodied in various forms such as a multiple configuration of side release buckles or the like. Straps 9 are connected together to attach the device while in the standing position. The support has a zipper edge 2 used for enclosing the device as will be described hereafter.

Figure 2:
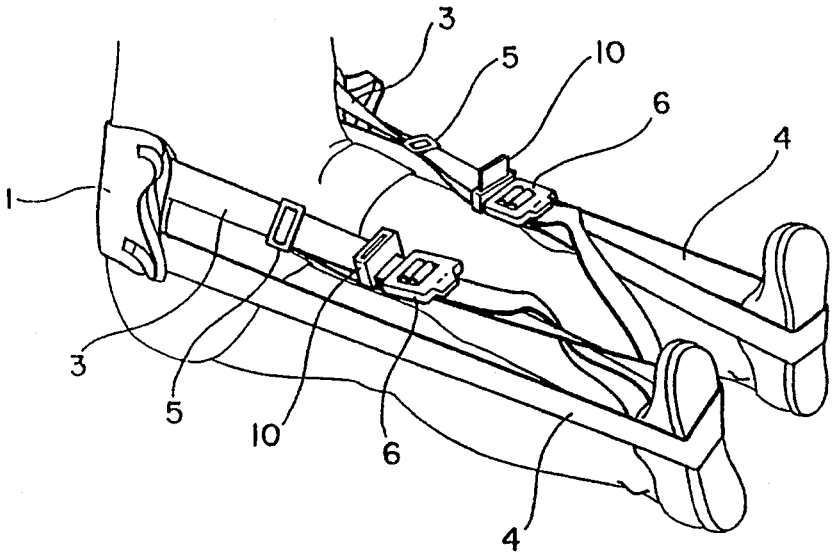
FIG. 2 is a perspective view of the present invention configured as a stretching aid.

FIG. 2 shows the device configured in the preferred embodiment. The straps 4 are fed through their respective buckles 6 and adjusted to a length which would allow them to loop around the feet of the user. In this configuration, the user could perform a variety of stretching exercises while maintaining full lower back support.

Figure 3:
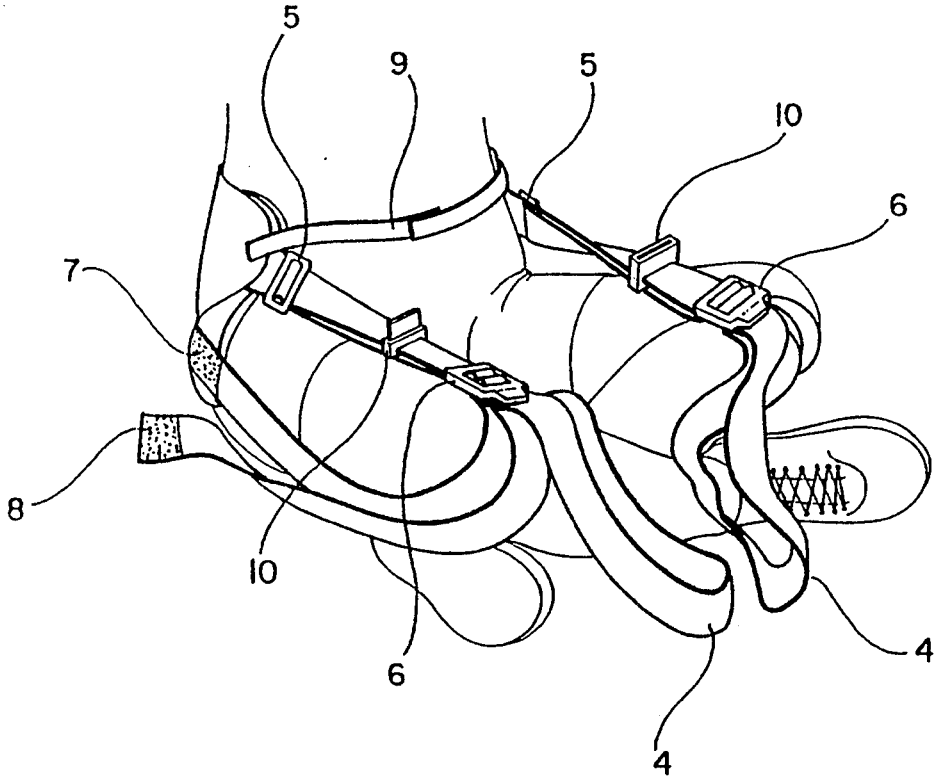
FIG. 3 is a perspective view of the present invention configured as a sitting back support.

FIG. 3 shows the device configured in an optional sitting arrangement with the legs not extended. In this configuration, each of the straps 4 are folded in half and fed through their respective buckles 6. The loose end of the straps 4 are connected (not shown) with their respective velcro fasteners 7 and 8. The folded straps provide for two distinct straps extending from buckle 6 which are separated across the knees of the user to provide for maximal dispersion of pressure over the shin area. This Figure shows the snap-in buckles 10 not connected.

Figure 4:
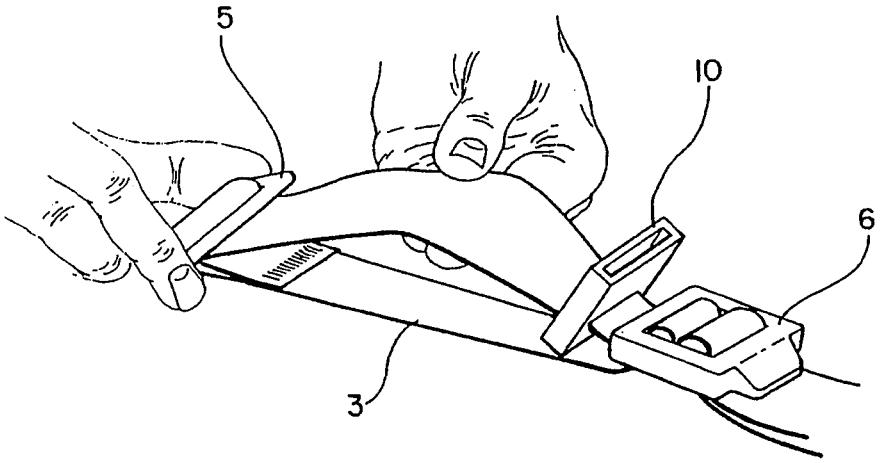
FIG. 4 is a perspective view of the present invention showing the strap-buckle configuration.
Figure 5:
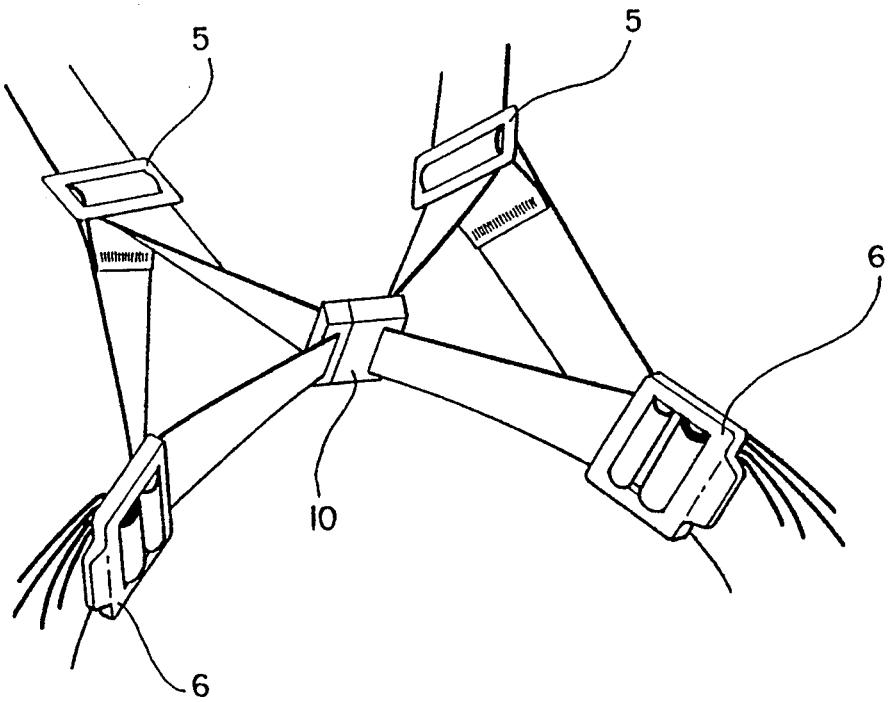
FIG. 5 is a close-up perspective view of the connections as per FIG. 8.

FIGS. 4 and 5 show close-up views of the buckle strap configurations. In FIG. 5, the snap-in buckles 10 have been connected. This connection prevents the user from separating their legs beyond a selectable limit.

Figure 6:
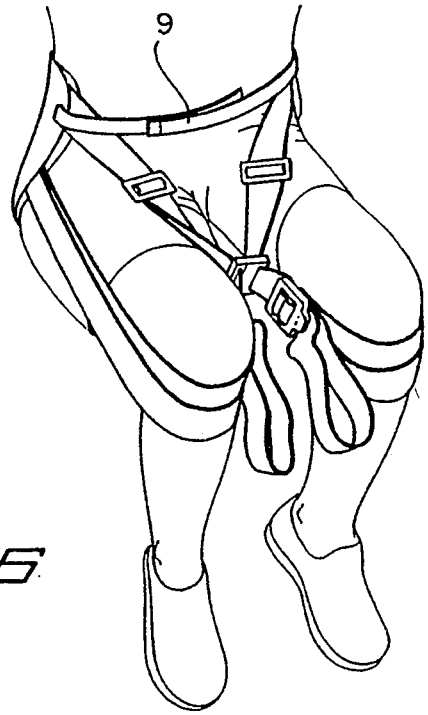
FIG. 6 is a perspective view of the present invention configured as a sitting back support with the pair of straps connected.
Figure 7:
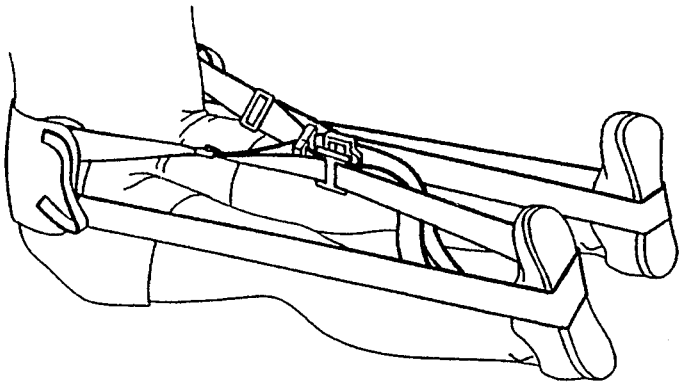
FIG. 7 is a perspective view of the present invention configured as a stretching aid with the pair of straps connected.
Figure 8:
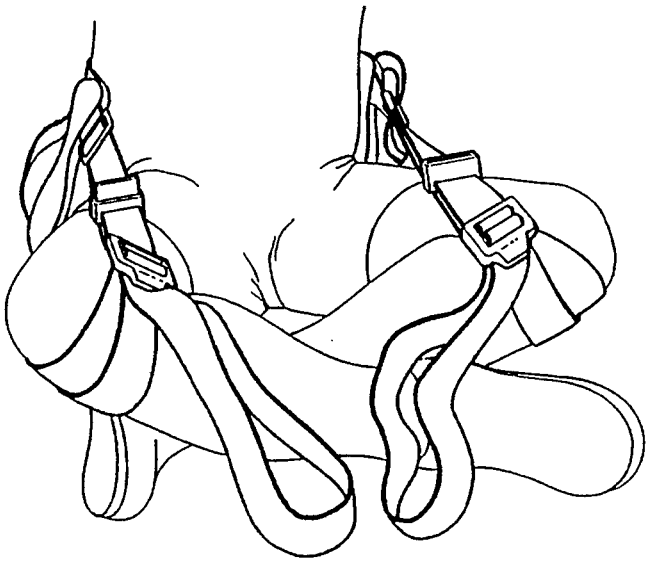
FIG. 8 is a frontal perspective view of the present invention used in the sitting cross-legged position.
Figure 9:
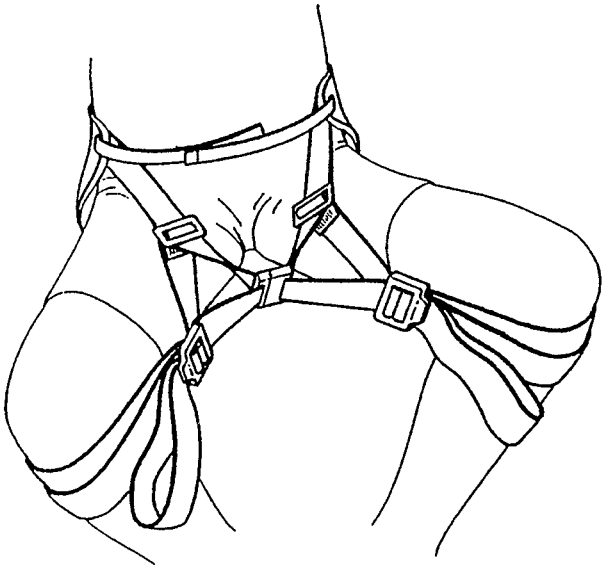
FIG. 9 is a frontal perspective view of the present invention used in the sitting cross-legged position with the straps connected.
Figure 10:
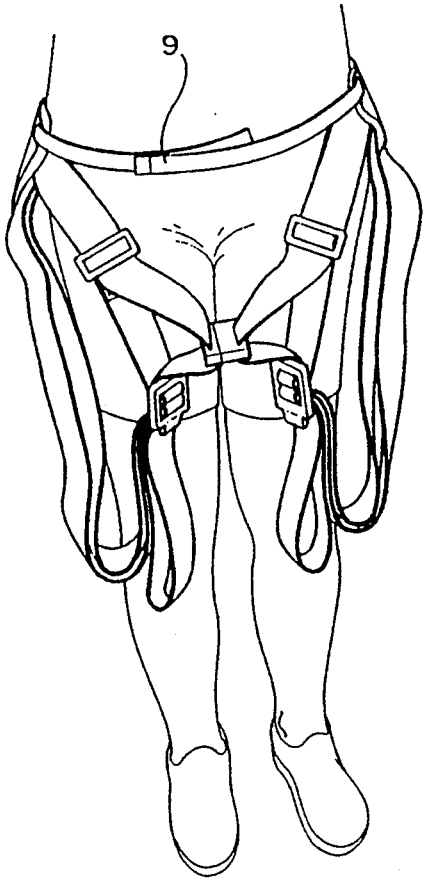
FIG. 10 is a frontal perspective view of the present invention and its associated attachment when configured in the standing position.

FIGS. 6–10 show various possible configurations of the present invention. In FIG. 6, the user is in a upright seated position with the snap-in buckles 10 attached and the waist strap 9 attached. In FIG. 7, the user is seated as in FIG. 2 but with the snap-in buckles 10 attached. FIG. 8 shows the user seated as in FIG. 3 and is included to demonstrate a close-up view of the double straps across the knees as previously described. In FIG. 9, the user is seated with the legs separated, but limited in outward mobility by the connecter 10. FIG. 10 demonstrates how the device remains attached while standing by connection of strap 9.

Figure 11:
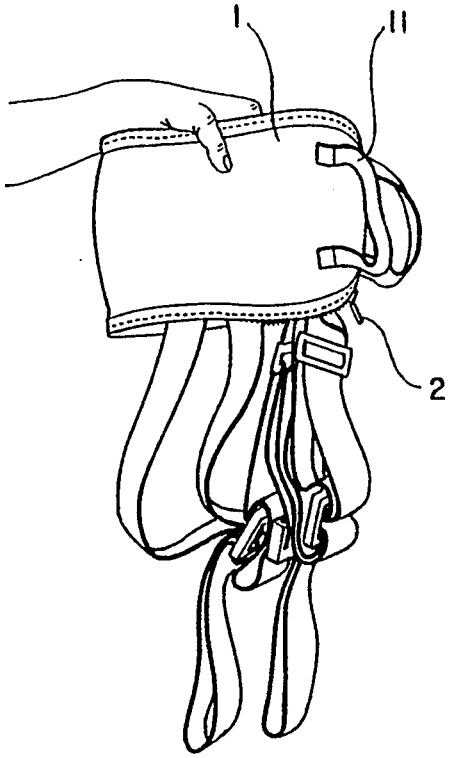
FIG. 11 shows the present invention being put into the back piece to become a carrying case.

FIG. 11 shows how the entire device may be encapsulated into the support 1. The support is folded in half and the straps with their respective buckles are placed inside. After the straps and buckles are placed inside the support 1 it is enclosed by zipper 2. Handles 11 provide a means to easily carry the device after it is fully closed. The support 1 is dimensioned to have a length which extends around the lower back of the user and a width which extends the height of the lumbar region.

Figure 12:
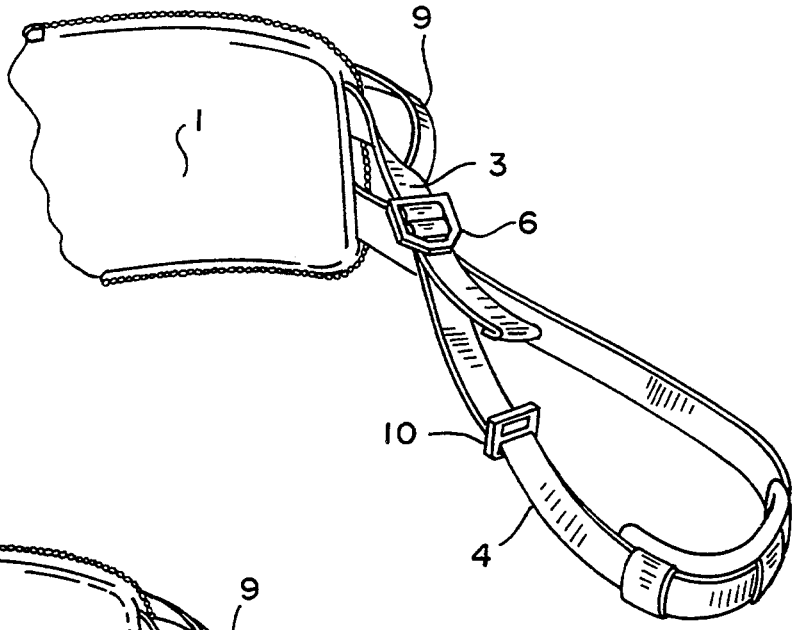
FIG. 12 shows a secondary embodiment with shorter straps and quick-release leg extensions.
Figure 13:
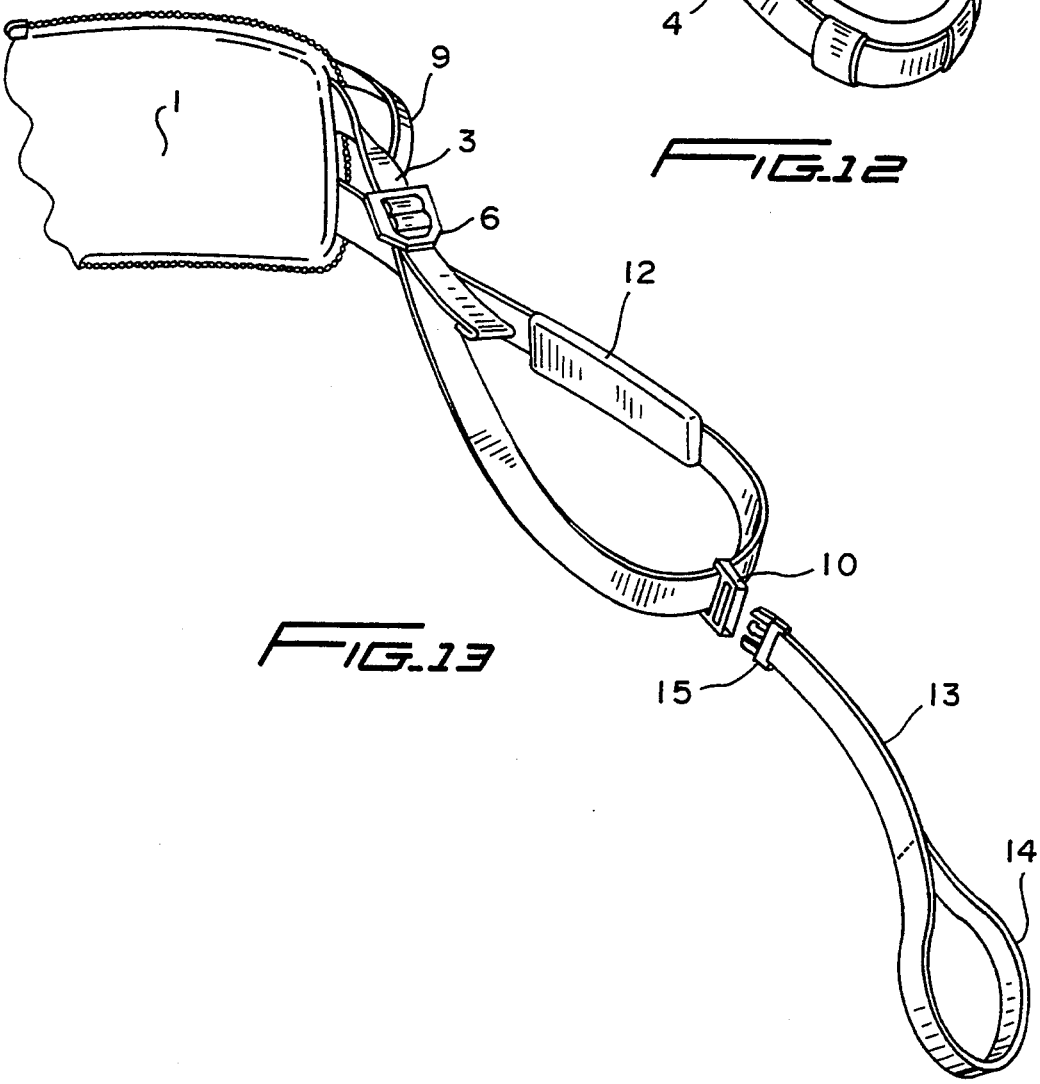
FIG. 13 shows the quick-release leg extensions.

FIGS. 12 and 13 illustrate an alternative embodiment having a slight variation in straps and buckles to allow for a quicker and simpler reconfiguration of the invention to the seated position with the legs extended. In this configuration each of the straps 4 are made substantially shorter. Each of the straps 4 further includes a knee pad 12 for even dispersement of pressure. The knee pad 12 serves as padding for the knee when the device is configured in the seated position with legs not extended. The "snap-in" buckle 10 is threaded onto strap 4 and is located between the knee pad 12 and the distal end of strap 4. Strap 3 is not adjustable in this configuration and consists of a unitary strap with no additional loop as per the first embodiment. An extension strap section 13 consists of a short (approx. 12 inches) single strap section with a bottom loop 14 of approximately 16 inches beginning to end. Theses sizes are for reference only. The invention is not to be limited by the above specific sizes to function properly. The strap 13 has an end connecter 15 which is the corresponding mate to the unattached buckle 10 located on each strap 4. When the "snap-in" buckle 10 is in the unconnected position, a female section will be located on one strap 4 and the corresponding reciprocal male section located on the other strap 4. Each of the extension straps 13 are attached to the straps 4 by their corresponding mate sections from buckles 10 and 15. As the extension straps are of a fixed length, the adjustment buckles 5 are not needed and therefore are not located on straps 3, as in the first embodiment.

To use in the seated position with the legs not extended, the distal end of strap 4 is fed through buckle 6 and is adjusted such that the knee pad 12 fits snugly around the knee of the user. Buckles 10 may or may not be connected, as described in the first embodiment, as is desired.

To use in the seated position with the legs extended, the extension straps 13 are connected via their proper connectors 10 and 15, as discussed above, with the loops 14 placed over the feet of the user. The buckle 6 is then adjusted such that the overall length of the straps fits snugly around the feet of the user.

Figure 14:
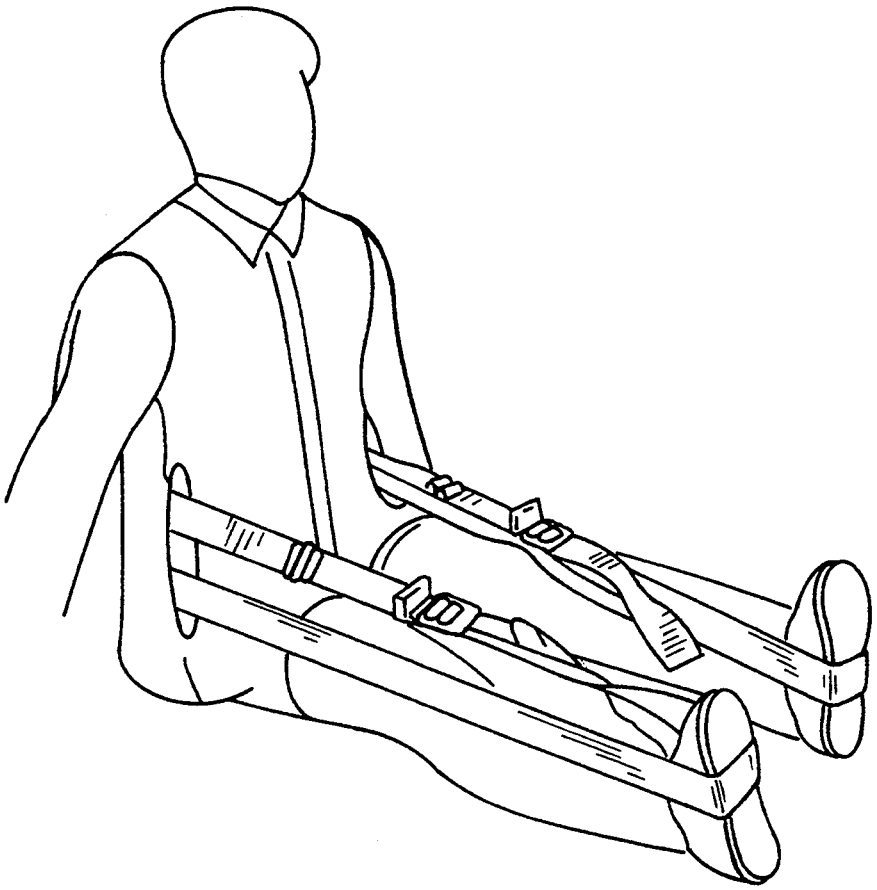
FIG. 14 shows the secondary embodiment incorporated into an upper torso garment.

In a third embodiment, the secondary embodiment may be incorporated into an upper torso garment as shown in my U.S. Pat. No. 4,813,080, entitled UPPER TORSO GARMENT WITH INTEGRAL BACK SUPPORT, hereby incorporated by reference. In this embodiment (FIG. 14), the stretch straps would be accessible from the interior of the garment and the support structure would be integral with the garment.

While various preferred embodiments have been shown and described, it will be understood that there is no intent to limit the invention by such disclosure, but rather, is intended to cover all modifications and alternate constructions falling within the spirit and scope of the invention as defined in the appended claims. The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

I claim:

1. A support device for supporting the lower back region of a user while in a seated position with legs extended comprising:

a double-ended, flexible, substantially rectangular, back support member having a length substantially spanning the width of the lower back of said user and a width substantially spanning the height of the lumbar portion of said user;

two pairs of straps each comprising at least a first and a second elongated strap each of said straps having a proximal end and a distal end;

said first and second straps attached by their proximal ends to one end of said double-ended, back-supporting member; a pair of first loops being formed with the connection of the distal ends of each of said first straps to the distal ends of each of said respective second straps; and, a third pair of straps, each having an elongated section with a loop formed on one end thereof and an end opposite said loop, operatively connected to a respective one of said first straps;

whereby the force of said user's feet on each of said loops of each of said third straps pulls said back supporting member against the lower back of said user to provide support and comfort while in the seated position with the legs extended.

2. A support device as per claim 1, wherein said device further comprises:

a plurality of first buckles for coupling and adjusting the size of each of said first loops; and, a plurality of second buckles for coupling each of said third straps to its respective first strap.

3. A support device as per claim 2, wherein said plurality of first buckles each comprises a ladder lock attachment and said plurality of second buckles comprises a male/female type buckle.

4. A support device as per claim 1, wherein said pairs of straps each comprise a first long strap and second shorter strap.

5. A support device as per claim 1, wherein said support device is incorporated into and made integral with an upper torso garment.

6. A support device for supporting the lower back region of a user while performing stretching exercises in a seated position with legs extended comprising:

a double-ended, flexible, substantially rectangular, back support member having a length substantially spanning the width of the lower back of said user and a width substantially spanning the height of the lumbar portion of said user;

two pairs of straps each comprising at least a first and a second elongated strap each of said straps having a proximal end and a distal end;

said first and second straps attached by their proximal ends to one end of said double-ended, back-supporting member; a pair of first loops being formed with the connection of said distal ends of each of said first straps to the distal ends of each of said respective second straps;

a third pair of straps, each having an elongated section with a loop formed on one end thereof and an end opposite said loop for engaging a user's foot operatively connected to a respective one of said first straps;

a plurality of first buckles for coupling and adjusting the size of each of said first loops; and, a plurality of second buckles for coupling each of said third straps to its respective first strap;

whereby the force of said user's feet on the loops of each of said third straps pulls said back supporting member against the lower back of said user to provide support and comfort while in the seated position with the legs extended.

7. A support device as per claim 6, wherein said plurality of first buckles each comprises a ladder lock attachment and said plurality of second buckles comprises a male/female type buckle.

8. A support device as per claim 6, wherein said pairs of straps each comprise a first long strap and second shorter strap.

9. A support device as per claim 6, wherein said support device is incorporated into and made integral with an upper torso garment.

10. An adjustable back support device for supporting the lower back region of a user either in a seated position or in a seated position with the legs extended comprising:

a double-ended, flexible, substantially rectangular, back support member having a length substantially spanning the width of the lower back of said user and a width substantially spanning the height of the lumbar portion of said user;

two pairs of straps each comprising at least a first and a second elongated strap each of said straps having a proximal end and a distal end;

said first and second straps attached by their proximal ends to one end of said double-ended, back-supporting member; a pair of first loops being formed with the connection of said distal ends of each of said first straps to the distal ends of each of said respective second straps;

a third pair of straps, each having an elongated section and a loop formed on one end thereof operatively connectable to a respective one of said first straps;

a plurality of first buckles for coupling and adjusting the size of each of said first loops;

a plurality of second buckles for coupling each of said third straps to its respective first strap; and, wherein connection of each of said third straps by said third strap buckles provides for said second loop to engage the feet of said user and not connecting said third straps allows the first loop to engage the knees of said user;

whereby the force of said user's knees or feet respectively on said first or second loops pulls said back supporting member against the lower back of said user to provide support and comfort while in the seated position with or without the legs extended.

11. A support device as per claim 10, wherein said pairs of straps each comprise a first long strap and second shorter strap.

12. A support device as per claim 10, wherein each of said first straps further comprises a knee pad to allow for dispersement of pressure around the knee when used in the sitting position with the legs not extended.

13. An adjustable back support device as per claim 10, wherein said adjustable back support device is incorporated into and made integral with an upper torso garment.

* * * * *